US006439226B1

(12) United States Patent
Johnson et al.

(10) Patent No.: US 6,439,226 B1
(45) Date of Patent: Aug. 27, 2002

(54) GLASS SURROUND FOR FIREPLACES

(75) Inventors: Timothy Wayne Johnson, Janesville; Marc Thomas Fuller, Minneapolis; Dan Curtis Shimek, Apple Valley, all of MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/617,708

(22) Filed: Jul. 17, 2000

Related U.S. Application Data

(60) Provisional application No. 60/144,293, filed on Jul. 16, 2000.

(51) Int. Cl.[7] ..... F24B 1/192

(52) U.S. Cl. ..... 126/547; 126/544; 126/121; 126/202; 126/548; 126/200; D23/406

(58) Field of Search ..... 126/547, 544, 126/545; 160/DIG. 9; 16/DIG. 11

(56) References Cited

U.S. PATENT DOCUMENTS 79,391 A * 6/1868 Rankin
2,294,046 A * 8/1942 Cser ..... 126/202
4,129,113 A * 12/1978 Bergstrom ..... 126/121
4,913,131 A * 4/1990 Peterson ..... 126/544
5,188,091 A * 2/1993 Gardner ..... 126/548
D345,012 S * 3/1994 Patel ..... D23/406
D345,204 S * 3/1994 Boka ..... D23/406

* cited by examiner

*Primary Examiner*—Carl D. Friedman
*Assistant Examiner*—Steve M Varner
(74) *Attorney, Agent, or Firm*—Merchant & Gould P.C.

(57) ABSTRACT

A front surround or enclosure for overlying the open front of a fireplace box is disclosed. The enclosure has a relatively narrow peripheral frame that carries one or a plurality of glass panels that substantially fill the enclosed area defined by the outer frame. The glass panels may be rigidly secured to the frame or can be configured as operable doors. Patterns configured by silk screening or other application techniques are selectively applied, preferably to the inner surface(s), of the glass panel(s) to enhance visual appeal of the glass and/or to selectively mask the viewer's vision through the glass. Quick release brackets are provided for detachably securing the enclosure to the front of a fireplace box.

13 Claims, 3 Drawing Sheets

GLASS SURROUND FOR FIREPLACES

RELATED APPLICATIONS

This application claims priority under 35 U.S.C. §119(e) from Provisional Patent Application No. 60/144,293 filed Jul. 16, 2000.

FIELD OF THE INVENTION

This invention relates generally to fireplaces and more particularly to a glass enclosure for closing the front of an open fireplace box.

BACKGROUND OF THE INVENTION

Fireplaces have been used for centuries as a means for providing heat, for cooking and for simply decorative purposes. Modern fireplaces typically have a front enclosure panel that may be sealed to the front of the fireplace box, or which may include operable doors enabling access into the fireplace box.

The fireplace box that defines the combustion chamber can assume a number of different configurations. In traditional wood burning fireplaces of brick or mortar construction, the combustion chamber generally extends over the full height of the. fireplace box, and a log holding grate rests on the floor of the combustion chamber. For gas burning fireplaces, the burner assembly and associated gas supply mechanisms are typically located below the floor of the combustion chamber but often still within the open cavity defined by the fireplace box. A number of fireplaces also include a heating plenum that pulls room air into the plenum near the bottom of the. fireplace box, heats the air, and emits the heated air back into the room near the top of the fireplace box. In order to provide an aesthetically pleasing design for the fireplace front enclosure, most such enclosures provide wide metal panels near the top and bottom portions of the open front fireplace box assembly, to cover or mask the unsightly looks of the mechanisms or openings located at those positions. Such molded panels may be typically coated with brass, bronze or anondized metal finishes. The vertical area between the upper and lower decorative metal panels, generally contains one or more panels of glass that can be of a nature that forms a seal with the front of the fireplace box or which includes operable door panels for gaining access to the combustion chamber.

It would be desirable from both aesthetic and cost viewpoints to eliminate the upper and lower metal decorative panels of a fireplace front enclosure and to form the entire front fireplace box enclosure from glass, except for the relatively narrow surrounding framework. The present invention addresses this need.

SUMMARY OF THE INVENTION

The present invention provides a glass surround or enclosure for the front of a fireplace box. The surround includes a glass enclosure or panel sized and configured to correspond to a front of the fireplace box, a support for securing the glass enclosure adjacent to the front of the fireplace box, and a pattern arrangement disposed on the glass enclosure for masking at least a portion of the contents of the fireplace box. In one aspect, the glass enclosure is comprised substantially entirely of glass, except for the support arrangement. The enclosure can be in the nature of a sealing panel, for sealing the open front of the fireplace box, or can include operable glass door members for enabling access into the fireplace box. The enclosure member can be configured for attachment to any type of fireplace assembly, whether of masonry or brick construction, of prefabricated modular construction, of retrofit insert construction for existing fireplaces, or the like.

The surround enclosure panel includes a support for securing the enclosure adjacent to the front of the fireplace box, for example, a heat resistant adhesive, or conventional mechanical fasteners, such as bolts or the like. In another aspect, the support includes an outer frame of relatively narrow or a thin profile configuration when viewed from the front of the panel, that operatively peripherally supports one or more panels of glass. The glass panels substantially fill or close the area peripherally defined and encircled by the frame. The frame is preferably made from a metal material; however, the construction need not necessarily be of metal. The frame includes fasteners that can be in the form of one or more hanger members for detachably securing the frame and the glass carried thereby to the front of a fireplace box.

Silk screened patterns of various shapes and configurations can be applied to the back or inner surfaces of the glass panel(s) at selected positions therealong, to visually mask portions of the fireplace box when viewed from outside of the enclosure. For example, a rectangular surround enclosure panel may include a screened rectangular portion adjacent the top of the glass panel(s) for masking unsightly structures near the top edge of the fireplace box, and might include a similar rectangular silk screened portion near the bottom of the glass panel(s) for masking the burner assembly structure in a gas burning fireplace. Alternatively, or in addition to the use of silk screening for masking out unsightly portions of the fireplace box, the screening may be applied to the glass in various patterns, shapes and/or in graphical manner soas to provide a desired aesthetic look or viewing area through the glass and into the combustion chamber when the glass is illuminated from within the fireplace box, as it might be when there is a flame burning within the combustion chamber.

Some embodiments of the invention are particularly well suited for gas burning fireplaces to mask the burner assembly and associated gas supply mechanisms or heating. Other embodiments are particularly well suited for modern wood burning fireplace box inserts that include heating plenums, and are designed to cover or mask the unsightly looks of the mechanisms or openings.

These and other features of the invention will become apparent to those skilled in the art upon a more detailed description of preferred embodiments of the invention.

BRIEF DESCRIPTION OF THE DRAWINGS

Referring to the drawings wherein like numerals represent like parts throughout the several views.

DETAILED DESCRIPTION OF THE PREFERRED EMBODIMENT

Figure 4:
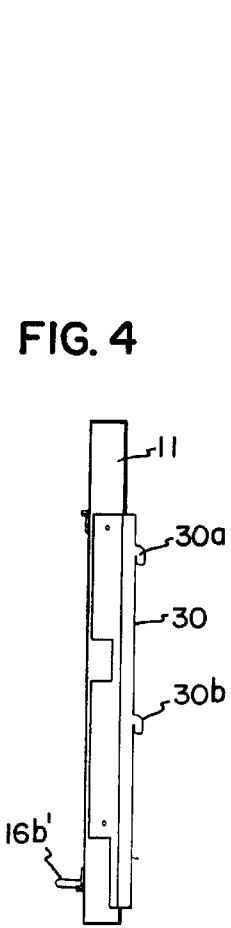
FIG. 4 is a cross-sectional side view of the glass surround enclosure of FIG. 1, generally taken along 4—4 in FIG. 1.

Referring to the figures, a first embodiment of a glass surround enclosure generally constructed according to the principles of this invention is illustrated at 10 in FIGS. 1–4. The enclosure includes a support for securing the enclosure adjacent to the front of the fireplace box, for example, a heat resistant adhesive, or conventional mechanical fasteners, such as bolts or the like. In an alternative embodiment, the support includes an outer frame 11 of relatively narrow or a thin profile configuration when viewed from the front of the panel, that operatively peripherally supports one or more panels of glass. The peripheral, relatively narrow profile frame 11 is sized to cooperatively engage the front surface of a fireplace box soas to cover the surface area defined by the open front of the fireplace box. An upper panel of glass 12 is mounted to the inner surface of the frame 11, and a pair of hinged door assemblies 13 and 14 are respectively mounted to the frame 11 by vertically spaced hinge pairs 15 and 16 respectively. The left hinged door assembly 13 includes a pair of pivotally connected glass panels 13*a* and 13*b* hinged about upper and lower hinge pairs 15*a* and 15*b* to the left side of the frame 11. The right door assembly 14 includes a pair of glass door panels 14*a* and 14*b* pivotally connected to one another and supported by the upper and lower hinges 16*a* and 16*b* to the right side portion of frame 11. Each of the hinged door assemblies 13 and 14 includes a handle 17 and 18 respectively for opening and closing the hinged door assemblies.

The upper edges of the door assemblies 13 and 14 include a cap of extruded decorative metal 20, and their lower edge is also trimmed by a thin strip of decorative metal 21. In the embodiment illustrated, their is a narrow gap 22 between the lower edge of the upper glass panel 12 and the upper edge of the metal strip 20. There is also a small gap 23 between the lower edge of the metal strip 21 of the door assemblies and the upper edge of the frame 11.

The back or inside surface of the upper panel 12 contains an applied silk screen pattern, generally indicated at P1 that, in the preferred embodiment, forms an opaque image through the upper glass panel 12 when viewed from the front of the assembly. Similarly, there is a rectangular silk screen pattern P2 applied to the inner surface of the glass panel door members 13 and 14 adjacent their respective lower edges that is also visually opaque to an observer looking through the glass doors from the front of the surround enclosure. When there is no light being emitted from the fireplace box cavity that the glass surround is covering, one does not readily perceive the existence of the silk screen coating on the back of the glass surfaces of the enclosure. Therefore, the overall visual effect to an observer looking at the glass enclosure, is that the enclosure is simply a full glass panel that provides a pleasing visual effect that is generally uninterrupted by heavy metal panels as was the case with prior art enclosures. However, when light is emitted from within the fireplace box and through the glass surfaces of the surround 10, the silk screened portions will prevent the light from passing therethrough and provide a masked visual effect to the outside viewer, as defined by the shape and pattern of the silk screen patterns applied to the glass. It will be appreciated that while simple rectangular silk screen configurations have been illustrated in FIG. 1, other patterns could equally well have been applied to the glass, such as circular or diamond shaped configurations, or the like.

Figure 3:
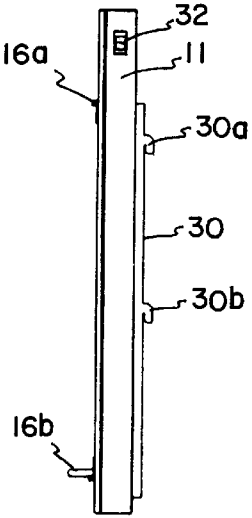
FIG. 3 is a right side elevational view of the glass surround enclosure of FIG. 1.
Figure 2:
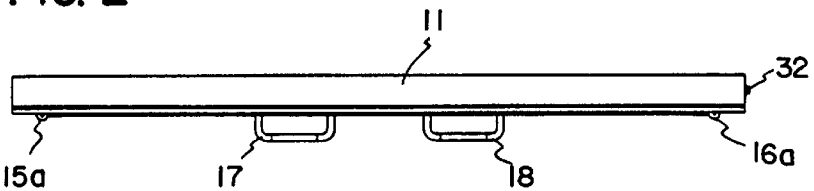
FIG. 2 is a top elevational view of the glass surround enclosure of FIG. 1.
Figure 1:
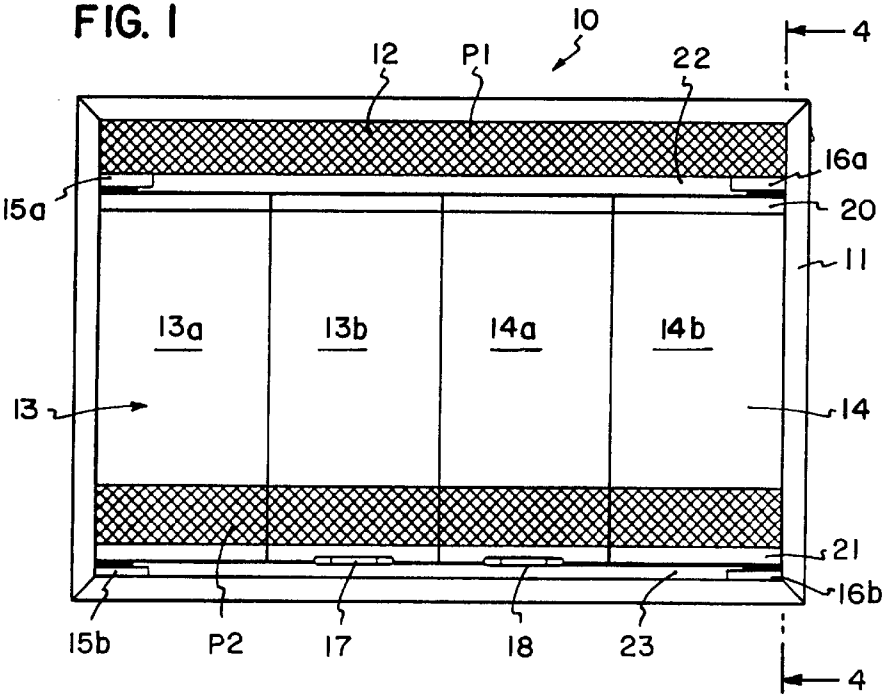
FIG. 1 is a front elevation view of a first embodiment of a glass surround enclosure according to the principles of this invention.
Figure 7:
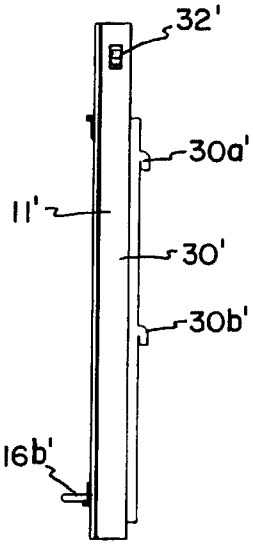
FIG. 7 is right side elevational view of the glass surround enclosure of FIG. 5.
Figure 8:
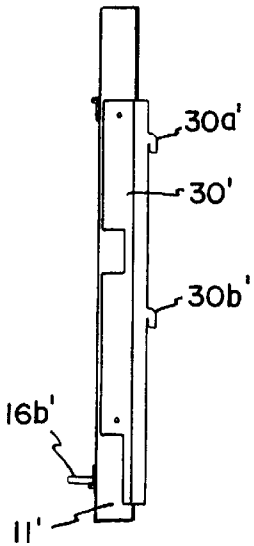
FIG. 8 is a cross-sectional end view of the glass surround enclosure of FIG. 5, generally taken along the Line 8—8 of FIG. 5.
Figure 6:
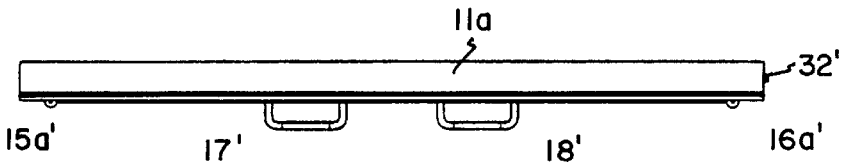
FIG. 6 is a top elevational view of the glass surround enclosure of FIG. 5.
Figure 5:
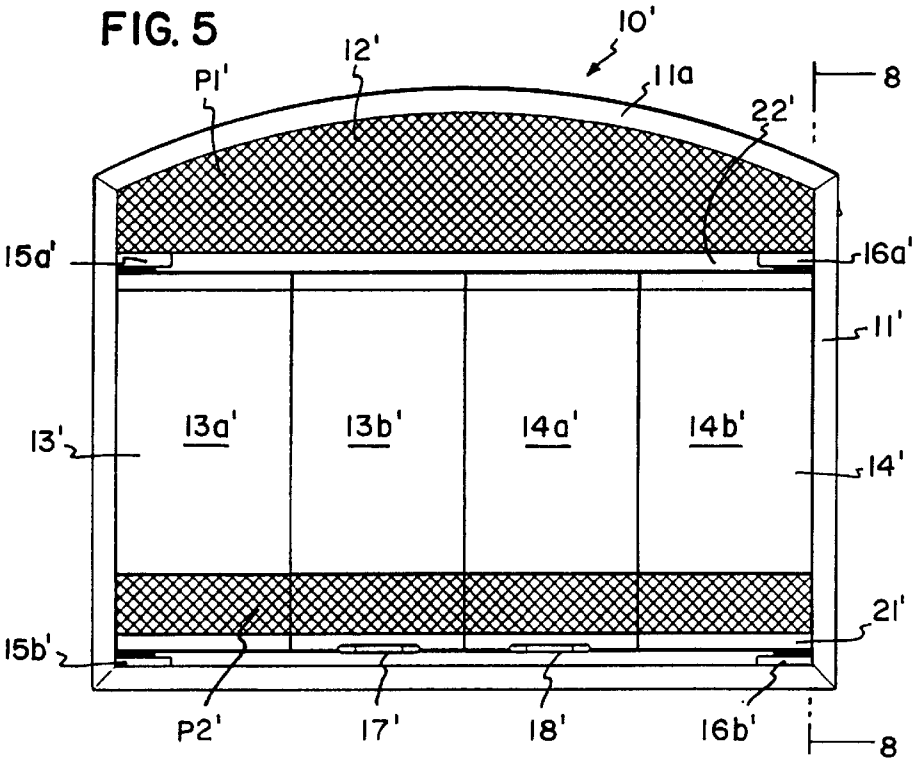
FIG. 5 is a front elevational view of a second embodiment of a glass surround enclosure of the present invention.

FIGS. 3 and 4 illustrate connection of a support bracket 30 to the frame 11. The bracket 30 has a pair of "J" hooks 30*a* and 30*b* that simply slide within receptor slots (not illustrated) appropriately positioned in the front surface of the fireplace box to which the glass surround enclosure 10 is to be secured. In the preferred embodiment, there are a pair of such support brackets 30, one each being secured to each of the upright end portions of the frame 11. It is illustrated in FIG. 3, there is also a toggle switch 32 mounted to the right side portion of the frame 11 which can be used for multiple purposes such as activating a blower, energizing a gas burner system, or the like.

A second embodiment of a glass surround enclosure 10' configured according to the principles of this invention is illustrated in FIGS. 5–8. Parts similar in construction and function in the second embodiment as compared to the first embodiment are illustrated by the same numerical designations, followed by a prime designation. The glass surround enclosure 10' is basically the same in construction and function as enclosure 10 of the first embodiment, except that the upper member 11*a* of the frame 11' is arcuately shaped, and the upper glass panel 12' has a curved upper surface to match the arcuate shape of the upper frame member 11*a*. As with the first embodiment, the entire back surface of the upper glass panel 12' is coated by silk screening.

It will be appreciated by those skilled in the art, that the silk screening applied to the glass can assume many different forms. For example, the consistency of the silk screened pattern could be solid, could be a dotted configuration as for example applied by a laser jet applicator, or like. Further, the patterns applied to the glass need not necessarily be silk screened or even opaque patterns, but could be patterns formed by other application techniques such as by etching of designs or the like into the glass. Further, as stated above, the designs need not be peripheral or specific shape-defining patterns, but could be in the nature of monograms, letters, or other configurations.

Figure 9:
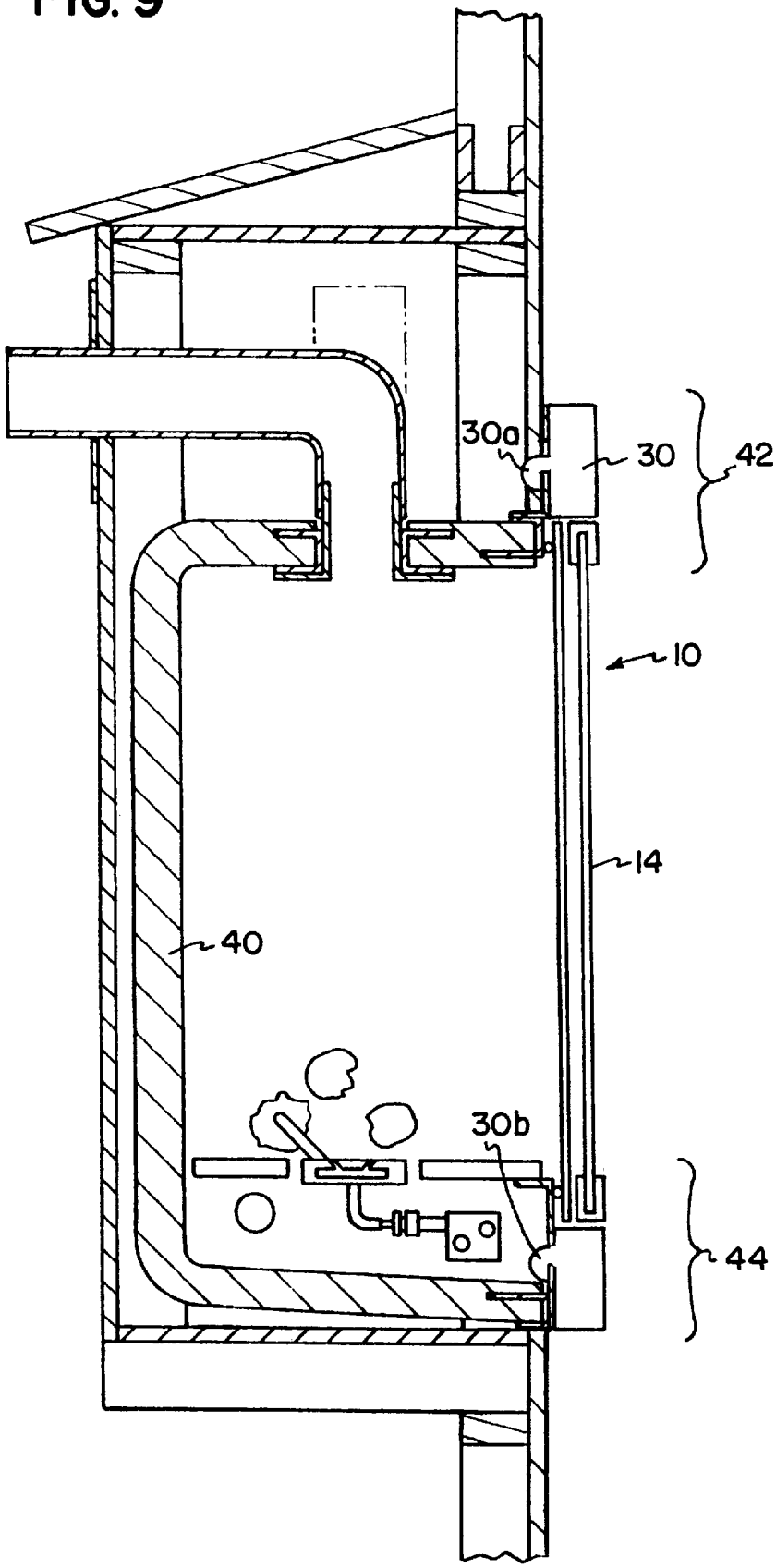
FIG. 9 is a diagrammatic schematic cross-sectional side view of the enclosure of this invention illustrated mounted to a fireplace box constructed of molded ceramic material and installed within a wall.

FIG. 9 illustrates the surround enclosure 10 as it might appear in cross-section as mounted to the front of a fireplace box assembly 40. The fireplace box assembly 40 is of a type that is molded from a highly insulative ceramic material as disclosed in pending U.S. patent applications Ser. No. 08/538,866 filed on Jan. 19, 1996 entitled Universal Non-Porous Fiber Reinforced Combustion Chamber and U.S. patent application Ser. No. 09/024,285 filed on Jul. 6, 1999 entitled Low Cost Prefabricated Fireplace With Fiber Insulation Firebox. The firebox assembly 40 is illustrated as it would appear mounted in a wall of a building. However such fireplace box assemblies are also ideal for insertion within existing fireplaces and enclosures for retrofit applications. As an example only, in such applications it would be desirable to have a front enclosure 10 such as that disclosed in this application, having an upper silk screen masked area P1 for masking view of the structure in the area illustrated at 42, and a lower silk screen masked area P2 for masking the structure in the area illustrated at 44. While this invention is particularly attractive for use in association with "insert" type fireplaces, its principles are not limited to such application. Other applications for the enclosure will be apparent to those skilled in the art.

These and other features of the invention will become apparent to those skilled in the art. The specific examples illustrated are not intended to be limiting to the invention, but are intended only for the purposes of providing specific examples illustrating use of and principles related to the invention. The invention is not to be limited in any manner by the descriptions herein provided. Rather, the invention is to be accorded the full scope and protection of the appended claims.

We claim:

1. A fireplace surround for enclosing a fireplace box, the surround comprising:

(a) a glass enclosure sized and configured to correspond to a front of the fireplace box; the glass enclosure having an upper panel and a lower panel; the lower panel includes a first door assembly and a second door assembly; each of the door assemblies for providing access to the fireplace box;

(b) a support for securing the glass enclosure adjacent to the front of the fireplace box; and (c) an opaque pattern arrangement disposed on the upper panel and a lower region of each of the first and second door assemblies; the pattern arrangement constructed and arranged to mask the contents of the firebox.

2. The fireplace surround according to claim 1, wherein:

(a) the support includes a frame member extending around a periphery of the glass enclosure.

3. The fireplace surround according to claim 2, wherein:

(a) the frame member includes one or more hook members for engaging the front of the fireplace box and supporting the glass enclosure adjacent to the fireplace box.

4. The fireplace surround according to claim 2, wherein:

(a) the frame member is made from metal.

5. The fireplace surround according to claim 2, wherein:

(a) the first door assembly includes a first door panel and a second door panel; the first door panel of the first door assembly being pivotally connected to the second door panel of the first door assembly; the first door panel of the first door assembly further being hingedly supported to the upper panel with an upper hinge and hingedly supported to the frame member with a lower hinge; and (b) the second door assembly includes a first door panel and a second door panel; the first door panel of the second door assembly being pivotally connected to the second door panel of the second door assembly; the first door panel of the second door assembly further being hingedly supported to the upper panel with an upper hinge and hingedly supported to the frame member with a lower hinge.

6. The fireplace surround according to claim 5, wherein:

(a) the second door panel of the first door assembly having a handle to selectively open and close the first door assembly to provide access to an interior of the fireplace box; and (b) the second door panel of the second door assembly having a handle to selectively open and close the second door assembly to provide access to the interior of the fireplace box.

7. The fireplace surround according to claim 6, wherein:

(a) the glass enclosure defines a first gap between the upper panel and the lower panel and a lower gap between the lower panel and the frame member.

8. The fireplace surround according to claim 1, wherein:

(a) the glass enclosure constructed and arranged to seal the front of the fireplace box.

9. The fireplace surround according to claim 1, wherein:

(a) the upper glass panel has a top edge; the top edge being arcuately shaped.

10. The fireplace surround according to claim 1, wherein:

(a) the pattern arrangement is opaque.

11. The fireplace surround according to claim 1, wherein:

(a) the pattern arrangement is disposed on an inner surface of the glass enclosure.

12. The fireplace surround according to claim 11, wherein:

(a) the pattern arrangement is silk screened on the inner surface of the glass enclosure.

13. The fireplace surround according to claim 11, wherein:

(a) the pattern arrangement is etched on the inner surface of the glass enclosure.

* * * * *

UNITED STATES PATENT AND TRADEMARK OFFICE

CERTIFICATE OF CORRECTION

PATENT NO. : 6,439,226 B1
DATED : August 27, 2002
INVENTOR(S) : Johnson et al.

It is certified that error appears in the above-identified patent and that said Letters Patent is hereby corrected as shown below:

Title page,
Item [60], Related U.S. Application Data, "Jul. 16, 2000" should read
-- Jul. 16, 1999 --

Column 1,
Line 7, "Jul. 16, 2000" should read -- Jul. 16, 1999 --

Signed and Sealed this

Sixth Day of May, 2003

JAMES E. ROGAN
*Director of the United States Patent and Trademark Office*